United States Patent [19]

Bowen et al.

[11] Patent Number: 4,486,640

[45] Date of Patent: Dec. 4, 1984

[54] COOKER/BAKER UTENSIL FOR MICROWAVE OVEN

[75] Inventors: Robert F. Bowen, Burlington; Thomas J. Martel, North Reading, both of Mass.

[73] Assignee: Raytheon Company, Lexington, Mass.

[21] Appl. No.: 438,209

[22] Filed: Nov. 1, 1982

[51] Int. Cl.[3] ..... H05B 6/80

[52] U.S. Cl. ..... 219/10.55 E; 219/10.55 F; 219/10.55 M; 426/243; 99/451; 99/DIG. 14

[58] Field of Search ..... 219/10.55 E, 10.55 F, 219/10.55 D, 10.55 R, 10.55 M; 99/451, DIG. 14; 426/234, 243; 126/390

[56] References Cited

U.S. PATENT DOCUMENTS

| | | | |
|---|---|---|---|
| 3,941,967 | 3/1976 | Sumi et al. | 219/10.55 E |
| 4,003,840 | 1/1977 | Ishino et al. | 252/62 |
| 4,166,208 | 8/1979 | Martel et al. | 219/10.55 E |
| 4,190,757 | 2/1980 | Turpin et al. | 219/10.55 E |
| 4,266,108 | 5/1981 | Anderson et al. | 219/10.55 E |
| 4,317,017 | 2/1982 | Bowen | 219/10.55 E |
| 4,362,917 | 12/1982 | Freedman et al. | 219/10.55 E |
| 4,398,077 | 8/1983 | Freedman et al. | 219/10.55 E |

FOREIGN PATENT DOCUMENTS

| | | | |
|---|---|---|---|
| 50-119049 | 9/1975 | Japan | 219/10.55 E |

OTHER PUBLICATIONS

"McCall's Flourishes With Food" (Brochure).

*Primary Examiner*—P. H. Leung

*Attorney, Agent, or Firm*—William R. Clark; Joseph D. Pannone

[57] ABSTRACT

A utensil for cooking or baking in a microwave oven. The utensil includes a partitioned tray and cover which are held in substantially fixed horizontal alignment by a microwave transparent base. The tray and cover are metallic and shield the interior there defined from microwave energy. A ferrite layer on the underside of the tray absorbs microwave energy to provide heat which conducts through the tray to the cooking compartments. The utensil can be used to fry and bake different foods simultaneous without intermixing the respective juices. Apertures in the cover provide for the escape of steam from the interior of the utensil.

7 Claims, 7 Drawing Figures

COOKER/BAKER UTENSIL FOR MICROWAVE OVEN

BACKGROUND OF THE INVENTION

It is common knowledge that microwave ovens cook with an entirely different principle than conventional gas or electric ranges. More specifically, with a microwave oven, heat is generated within the food body by molecular agitation and the air around the food body remains substantially unheated except for some relatively insignificant heat radiation by the food body. With a conventional surface heater (top burner or electric calrod) or oven, however, the heat is generated external to the food and conducted inwardly from the surface of the food. When baking in a conventional oven or frying on a conventional top surface heater, the surface of the food dries or browns to a texture that is considered appetizing. Accordingly, with certain food types, it is desirable to overcome the problem of microwave cooked food having a less appetizing external appearance.

The problem described of the previous paragraph is compounded by the advantage of a conventional range having the option to simultaneously fry and bake foods. For example, when preparing a breakfast, cornbread may be baked in the oven simultaneous to frying eggs and sausage on the surface heaters. Accordingly, the cooking can be conducted so that all three food items are done at the same time. Furthermore, the eggs and sausage can be cooked in separate pans if it is desirable to keep their juices from mixing. In most microwave ovens, however, there is very little interior space. Accordingly, it is difficult to conduct separate cooking operations simultaneously. Furthermore a microwave chef has not had the capability to simultaneously bake and fry.

SUMMARY OF THE INVENTION

The invention defines a utensil adapted for simultaneously cooking a plurality of food bodies in a microwave oven, comprising a metallic pan having a partitioned interior for separating said food bodies into respective compartments, a layer comprising ferrite bonded to the underside of the pan, the layer absorbing microwave energy to provide heat which conducts through the pan to the food bodies, a microwave transparent base for supporting the pan in an elevated position in the oven, the base contacting a peripheral region of the pan spaced from the layer, a metallic cover supported by the base, the cover and pan being positioned in substantially fixed horizontal alignment with respect to each other wherein a gap is defined between substantially parallel surfaces, the surfaces being the outer perimeter of the pan and a region of the inner surface of the cover, and the cover having at least one aperture for venting steam from the interior defined by the combination of the pan and the cover. It may be preferable that the pan be substantially circular in shape and the borders of the compartments project radially. Also, it may be preferable that the layer define a band excluding the central region of the underside of the pan. The parallel surfaces of the cover and pan may be parallel in a vertical direction for a distance of approximately one-quarter of a wavelength of the microwave energy which may be 2450 MHz. A plurality of apertures may be spaced in a circle approximately four inches from the center of the cover to provide for venting of steam from the interior of the utensil.

The invention also may be practiced by the method of cooking a plurality of food bodies in a microwave oven, comprising the steps of positioning the food bodies in respective individual compartments formed in a metallic pan by substantially radial interior partitions, the pan having a ferrite layer bonded to at least a portion of the underside surface, supporting the pan in a microwave transparent base wherein the base contacts a peripheral region of the pan spaced from the layer, the pan having a substantially fixed horizontal alignment with the base, positioning a metallic cover over the pan, the cover being supported by the base wherein the cover is in a substantially fixed horizontal alignment with the base and the pan wherein a gap is defined between a peripheral region of the pan and the inner surface of the cover, and exposing the utensil to microwave energy wherein heat is generated in the layer by absorption, the heat conducting through the pan to the food bodies for cooking, the pan and the cover shielding the food bodies from microwave energy. It may also be preferable that the cover be provided with a vent for removing steam from the interior.

BRIEF DESCRIPTION OF THE DRAWINGS

The foregoing and other objects and advantages will be more easily understood by reading the Description of the Preferred Embodiment with reference to the drawings wherein.

DESCRIPTION OF THE PREFERRED EMBODIMENT

Figure 1:
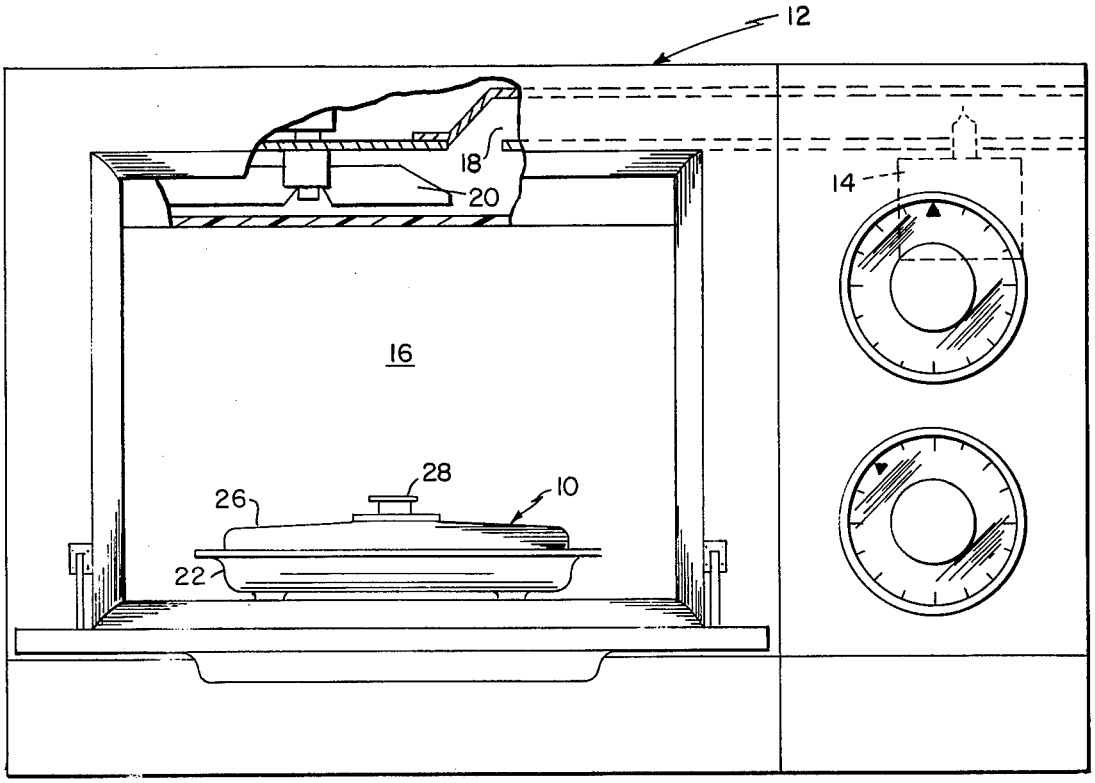
FIG. 1 is a view of the microwave cooker/baker positioned in a conventional microwave oven.

Referring to FIG. 1, there is shown a partitioned cooker 10 for use in a microwave oven 12. Typically, microwave energy having a frequency of 2450 MHz is provided by magnetron 14 and coupled to cavity 16 of oven 12 via suitable means such as, for example, through waveguide 18 and past mode stirrer 20. More preferably, a primary radiator (not shown) having a directive microwave radiation pattern may be used to couple the energy from waveguide 18 into cavity 16. Other conventional microwave oven parts and features such as, for example, the door seal, are not described in detail as they are well known in the art and form no part of the invention.

Figure 2:
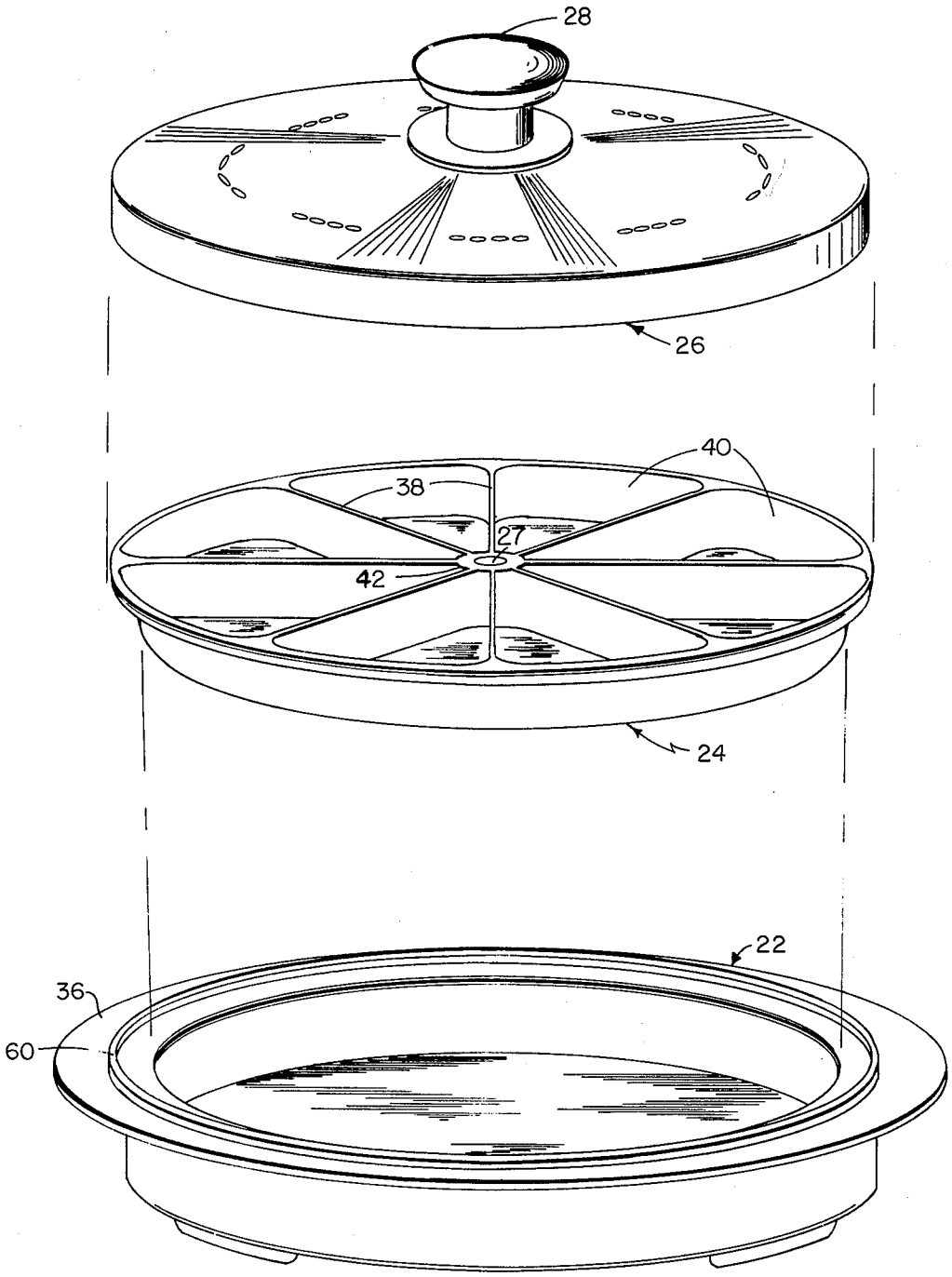
FIG. 2 is a isometric projection view of the cooker of FIG. 1 with the parts separated.

Referring to FIG. 2, an expanded view of partitioned cooker 10 is shown with the composite parts separated for illustration. More specifically, partitioned cooker 10 consists of base 22, pan or tray 24 and cover 26 which has a handle 28.

Figure 3:
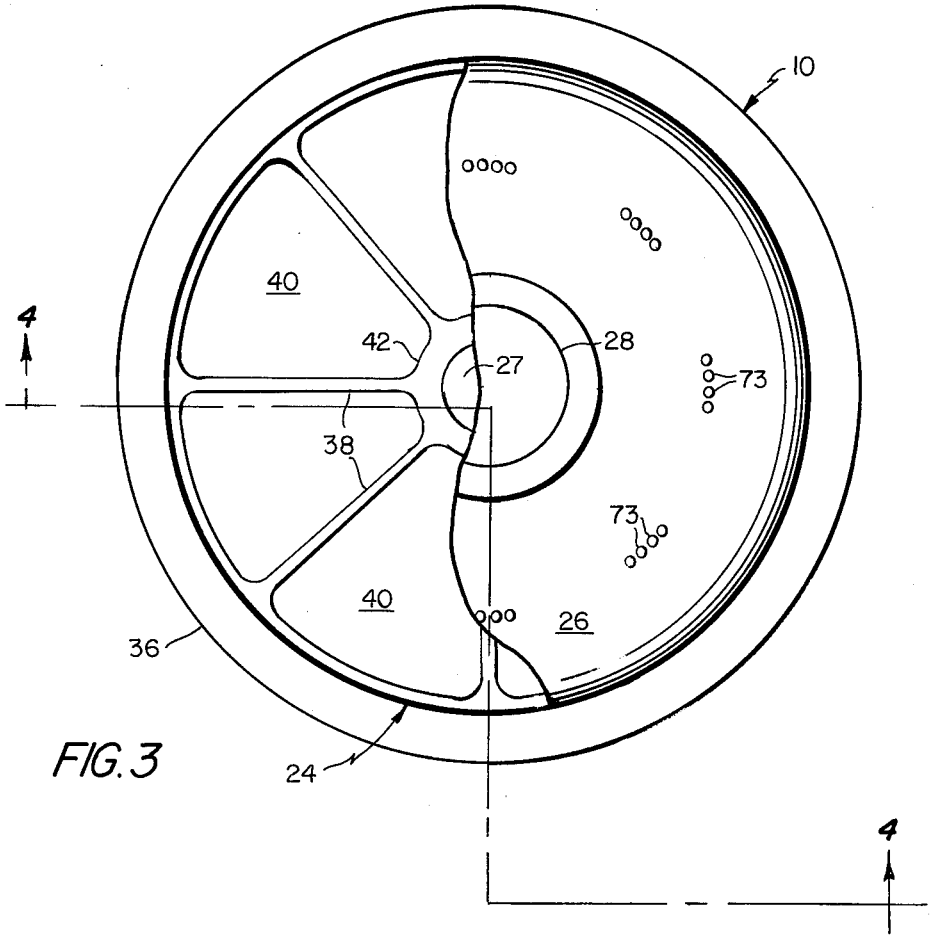
FIG. 3 is a partially cut away top view of the cooker.
Figure 4:
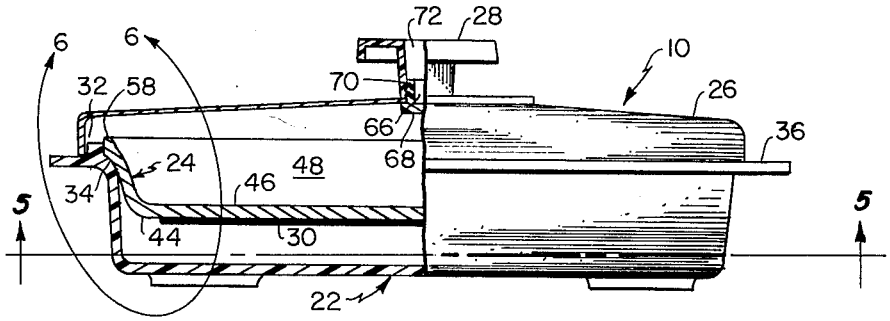
FIG. 4 is a side view of the cooker taken along line 4—4 of FIG. 3.

Referring to FIGS. 3 and 4, partially cut away top and side views of partitioned cooker 10 are shown; FIG. 4 is taken along line 4—4 of FIG. 3. Base 22 provides several functions. First, it elevates tray 24 within oven 12 so that layer 30 is not resting on the floor of cavity 16. Second, base 22 supports tray 24 and cover 26 in substantially fixed horizontal alignment so that there is a substantially constant gap 32 between them around their perimeters. Third, base 22 insulates layer 30 which heats in the presence of microwave energy so that cooker 10 may be picked up without the safety hazard of burning the operator. Base 22 is fabricated with a microwave transparent material so that the microwave energy can penetrate through the base to layer 30 as will be described in more detail later herein. One example of a material is a thermoset polyester which preferably may be compression or injection molded. Preferably, the thermoset polyester may have 15% to 20% glass or fiberglass by weight. Accordingly, the more expensive thermoset material is replaced in volume with the less expensive glass. Other examples of material that could be used for base 22 are polyphenylene sulfide, methylpentante, polysulfone, Teflon, ceramic, or stoneware. Although base 22 is spaced from layer 30, base 22 will still be subjected to relatively high temperatures. Accordingly, if using polysulfone, an additional insulation layer may be required. Polyphenylene sulfide and methylpentante have respective distortion temperatures of approximately 500° F. and 400° F. so that an additional insulation layer may generally not be required.

In FIGS. 3 and 4, base 22 is shown to be circular with the rim 34 of pan or tray 24 being supported on it around the perimeter. As will be described later, tray 24 may take on a shape other than circular in which case base 22 would preferably conform to the shape of the tray. Handle 36 extends outwardly from base 22 to provide for picking-up the utensil. The size of base 22 is determined by the size of tray 24.

Tray 24 supports the food bodies during cooking and is fabricated of a metal such as aluminum for shielding the food from microwave energy from below. The interior of tray 24 has partitions 38 for dividing the interior into a plurality of compartments 40. In the embodiment shown, partitions 38 run radially from a concentric circle 42 in the center of tray 24. Hole 27 in the center may be used to place and remove tray 24 from base 22 when the tray is cool. As shown, there are eight partitions substantially resulting in eight truncated pie-sectioned compartments. The partitions preferably have a slope in the range from 85° to 87° so that food can more easily be removed from compartments 40. Also, it may be preferable to coat the compartments with Teflon so that food will not stick thereto. Furthermore, the junction between partitions 38 and the bottom of tray 24 may preferably have a 0.25 inch radius for ease of cleaning and food removal. Attached to the undersurface 44 of the bottom 46 of tray 24 is layer 30 which heats in the presence of microwave energy. The heat generated therein conducts through the bottom 46 of the tray heating the interior 48 of the partitioned cooker 10. It may be preferable that layer 30 consist of a flexible plastic having ferrite particulate dispersed therein. More specifically, layer 30 may comprise high temperature silicone having a thickness in the range from 0.05 to 0.15 inches and the ferrite particles may be ferrite Ql supplied by Indiana General. In some temperature and geometry applications, a thickness of 0.08 inches may be optimum. Layer 30 may be bonded to the undersurface 44 of tray 24 using well known methods. In an alternate construction technique, layer 30 may be spray bonded onto the underside 44 of tray 24. Tray 24 may preferably have a 9 or 10 inch diameter.

Figure 5:
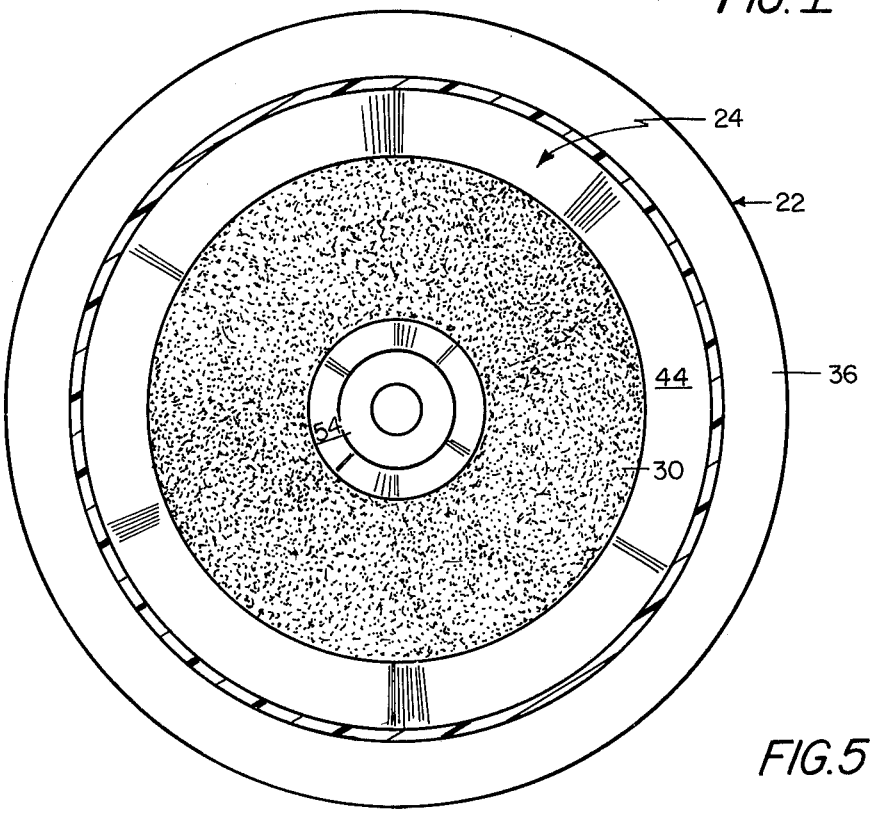
FIG. 5 is a bottom view of the cooker taken along line 5—5 of FIG. 4.

It may be preferable that layer 30 define a relatively thick band around the underside 44 of tray 24 leaving an uncovered section 54 in the middle as shown in FIG. 5. By experimentation, the dimensions and thickness of layer 30 may be determined to provide a desired cooking temperature in the interior 48 of the cooker 10. Preferably, tray 24 may be fabricated from aluminum using a casting method. Alternatively, fabrication techniques may include stamping or individual fabrication of compartments 40. Other materials such as steel or stainless could be used but do not provide the excellent thermoconductivity of an aluminum casting.

Although tray 24 is shown with truncated pie-sectioned compartments, it may be preferable that compartments have another shape such as square or rectangular. In such case, it may be preferable that the shape of tray 24 be other than circular such as, square, for example. With a substantially square tray, the partitions would define square or rectangular compartments 40. As described before, if the outer perimeter of tray 24 defined a shape other than circular, base 22 would have a conforming shape to provide support for the entire perimeter of tray 24.

Cover 26 is fabricated of a microwave reflective or conductive material such as, for example, aluminum. The combination of tray 24 and cover 26 provides a cooker interior 48 which is not subjected to any significant amount of microwave energy. Specifically, referring to FIG. 6 which is an expanded view of the identified portion of FIG. 4, when cover 26 is positioned on base 22, it is held in substantially fixed horizontal alignment with tray 24 by riser 60 which may be positioned inside, as shown or outside of cover 26. The outer surface 62 of lip 58 is substantially parallel with a portion 65 of the inner wall of the cover in a vertical direction to form a partial microwave choke. In theory, for optimum sealing, it may be preferable that the vertical parallel distance of the pan and the cover be an odd multiple of a quarter wavelength of the microwave energy. In practice, it has been found that a distance of an inch or greater is more than adequate and a distance of $\frac{5}{8}$ of an inch is sufficient. It is not essential that an absolute choke be formed by surfaces 62 and portion 65 because a very small amount of leakage to interior 48 will not have a significant effect on the performance of cooker 10 as described later herein. However, it has been determined that for foods that have an enclosed membrane such as the yoke of an egg, a rapid internal temperature rise caused by exposure to microwave energy can result in an explosion. Accordingly, steps must be taken to substantially limit the leakage. For the embodiment of FIG. 6, it is important that gap 32 be substantially uniform or constant around the entire perimeter of cover 26. If the gap is too small or surface 62 and portion 65 contact each other, arcing may occur. If the gap is too large, significant leakage of microwave energy into interior 48 may occur. Accordingly, this is the reason that is important that cover 26 and tray 24 be held in somewhat fixed horizontal alignment by base 22.

Figure 6:
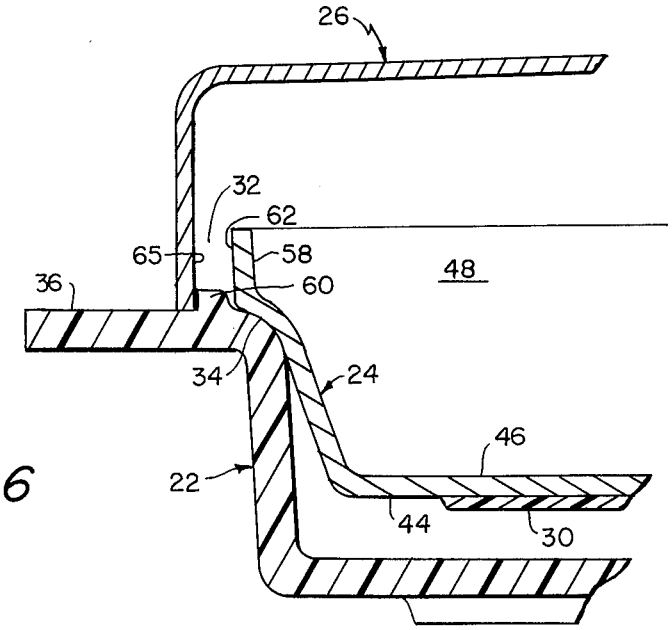
FIG. 6 is an expanded view of the indicated portion of FIG. 4.
Figure 7:
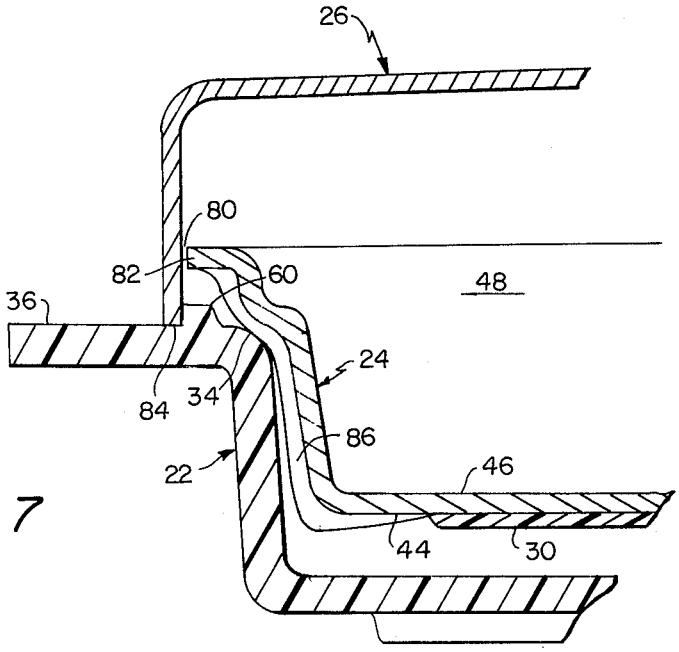
FIG. 7 is an alternate embodiment of FIG. 6.

Referring to FIG. 7, an alternate embodiment of the choking structure of FIG. 6 is shown. Rather than having parallel portions in the vertical direction, it has been found that if the spacing 80 between the perimeter edge 82 is limited to a very small distance such as, for example, 0.025 inches, adequate microwave choking is attained. Further, it has been determined that if the intersection point of edge 82 is spaced upwards from the bottom 84 of the cover approximately 0.5 inches, there will be no arcing between the cover and edge 82 and this is true even if they contact. A comparision of the effectiveness of various choking structures was conducted using 100 grams of water in the interior 48 without layer 30 as part of the configuration. Each test was run by exposing the utensil to 690 watts of microwave energy for two minutes. Without a cover, the temperature rise of the water was 129° F. Usi.ng the parallel embodiment of FIG. 6, the temperature rise was 48° F., 23° F. and 13° F. for respective vertical choke distances of 0.250, 0.625 and 0.750 inches. With the embodiment of FIG. 7 and a spacing of 0.025 inches, the temperature rise was 29° F.

Still referring to FIG. 7, ribs 86 are shown which substantially reduce the surface contact area between tray 24 and base 22. Accordingly, heat transfer to the base is thereby limited. Support can be attained by three or more ribs preferably equally spaced around the perimeter of tray 24. Also, the channels defined between the ribs permit air to flow upward from the inside of base 22.

In the center of cover 28 is a hole 66 having dimension below microwave cut-off for attaching handle 28. The handle preferable consists of a material such as polysulfone which is transparent to microwave energy to prevent arcing to cover 26 or acting as a center conductor for coupling microwave energy through hole 66. A lower temperature material might distort when subjected to the high temperature. Although handle 28 may be attached by a variety of conventional methods, it is preferable that the bottom 68 of handle 28 be larger than hole 66 and that a plug 70 be connected to handle 28 by ultrasonic bonding it into channel 72 in handle 28. Cover 26 has a plurality of apertures 73 positioned in a circumference approximately four inches from the center of the cover. The purpose of the apertures is to vent steam from the interior 48 of cooker 10. The apertures have a size below the cut-off for microwave energy to prevent microwave leakage into interior 48. The slots are positioned away from the handle 28 so that the operator may take cover 26 off without subjecting his hand to steam coming out of the slots.

In operation, individual food bodies are positioned in the respective compartments 40 of tray 24 as it is supported on base 22. Partitioned cooker 10 is used in a conventional domestic microwave oven 12 for cooking or baking a variety of foods. For example, in one application, cooker 10 can be used to bake such foods as cornbread or brownies. In such case, compartments 40 are greased and then the cornbread mix is poured into the individual compartments. Cover 26 is positioned over tray 24 and is horizontally aligned thereto by base 22. Cooker 10 is then placed in the microwave oven and microwave power radiated for an appropriate amount of time such as, for example, ten minutes. The microwave energy penetrates through base 22 and is absorbed by layer 30 providing heat which is conducted through tray 24 to interior 48. With the geometry as shown in FIGS. 3 and 4 and described with reference thereto, the temperature of interior 48 stabilizes at approximately 400° F. which is a desirable baking temperature. Stated differently, when the interior temperature of cooker 10 is approximately 400° F., the heat given off by layer 30 is approximately equal to the heat generated by absorption of microwave energy in layer 30. In addition to the geometry of cooker 10, the thermostating temperature can be determined by the parameters of layer 30. More specifically, because layer 30 is adjacent to a metal surface where the electric field component of the microwave energy is null, substantially all of the coupling is to the magnetic field component and that is significantly reduced at the Curie temperature of the ferrite.

Another example of an application of cooker 10 is frying such foods as eggs, bacon, ham, hamburg or sausage. Furthermore, with partitions 38, different food types can be cooked or baked simultaneously without intermixing the juices or greases of the respective foods. More specifically, cooker 10 has significant advantage in simultaneously preparing a variety of different food types for a meal such as breakfast. Because the cooking times may be different, it may be preferable that the different foods have different starting times. For example, all of the compartments may be greased and then cornbread mix poured into two compartments. At the same time, ham, hamburg, or bacon can be added to two other compartments. Then, the cooker with cover may be placed in the microwave oven with full power for approximately 6.5 minutes. After turning the meat and cornbread as desired, eggs can be added to the four empty compartments and the covered cooker replaced into the microwave oven for an additional two minutes. Vents permit steam to escape from the interior 48 of cooker 10 thus preventing the cornbread from being soggy.

Partitions 38 also provide an additional advantage. More specifically, when baking bread products in a conventional gas or electric oven, the heat conducts inward from all of the bread surfaces resulting in substantially uniform baking. With cooker 10, however, if there were no partitions, the only heat entering a bread product such as cornbread would be from the underside. With this configuration, it was found that by the time the upper surface was dry and appetizing, the bottom surface may have been burned. With the addition of partitions 38 being relatively thick aluminum casting, however, substantial heat is conducted from the sides. Accordingly, a much more uniform baking process is attained.

As described earlier herein, the combination of tray 24 and base 22 with the specified gap 32 therebetween provides a substantial shield of microwave energy. Accordingly, the food cooking in compartments 40 are substantially cooked by conduction heat alone without any appreciable amount of heat generated therein by microwave radiation. Accordingly, the foods have an extremely appetizing external surface. Furthermore, baking and frying may be simultaneously conducted without intermixing juices or grease.

The reading of this Description of the Preferred Embodiment will bring to mind many alterations and modifications without departing from the spirit and scope of the invention. Accordingly, it is intended that the scope of the invention be limited only by the appended claims.

What is claimed is:

1. A utensil adapted for baking individual food bodies in a microwave oven, comprising:

a metallic pan having a bottom and highly thermoconductive partitions separating said food bodies into respective compartments;

a layer comprising ferrite bonded to the underside of said bottom of said pan, said layer absorbing microwave energy to provide heat for conducting through said bottom and said partitions to enter the sides of said food bodies;

a microwave transparent base for supporting said pan in an elevated position in said oven, said base contacting a peripheral region of said pan spaced from said layer;

a metallic cover supported by said base, said cover and said pan being positioned in substantially fixed horizontal alignment with respect to each other wherein a gap is defined between substantially parallel surfaces, said surfaces being the outer perimeter of said pan and a region of the inner surface of said cover; and said cover having at least one aperture for venting steam from the interior defined by the combination of said pan and said cover.

2. The utensil recited in claim 1 wherein said pan has a substantially circular shape and said partitions project radially.

3. The utensil recited in claim 2 wherein said layer is omitted from a central region of said underside of said pan.

4. The utensil recited in claim 1 wherein said surfaces are parallel in a direction perpendicular to the edge of said cover for a distance of approximately one-quarter of a wavelength of said microwave energy.

5. The utensil recited in claim 1 wherein said cover has a plurality of apertures spaced around a circle approximately four inches from the center of said cover.

6. The method of baking individual food bodies in a microwave oven, comprising the steps of:

positioning said food bodies in respective individual compartments formed in a metallic pan by substantially radial highly thermoconductive interior partitions, said pan having a ferrite layer bonded to at least a portion of the underside surface;

supporting said pan on a microwave transparent base wherein said base contacts a peripheral region of said pan spaced from said layer, said pan having a substantially fixed horizontal alignment with said base;

positioning a metallic cover over said pan, said cover being supported by said base wherein said cover is in a substantially fixed horizontal alignment with said base and said pan wherein a gap is defined between a peripheral region of said pan and the inner surface of said cover; and exposing said utensil to microwave energy wherein heat is generated in said layer by microwave energy absorption, said heat conducting through said pan and said partitions to said food bodies for cooking, said pan and said cover shielding said food bodies from said microwave energy.

7. The method recited in claim 6 further comprising the step of providing a vent for removing steam from the interior defined by the combination of said pan and said cover.

* * * * *